US005671950A

United States Patent [19]

Hanson

[11] Patent Number: 5,671,950

[45] Date of Patent: Sep. 30, 1997

[54] FASTENABLE BINDER WITH INSERT

[75] Inventor: Charles Hanson, Dallas, Tex.

[73] Assignee: Ampad Corporation, Dallas, Tex.

[21] Appl. No.: 721,502

[22] Filed: Sep. 26, 1996

[51] Int. Cl.[6] ..... B42D 3/00

[52] U.S. Cl. ..... 281/29; 281/37; 281/51

[58] Field of Search ..... 281/29, 31, 37, 281/38, 51; 402/79

[56] References Cited

U.S. PATENT DOCUMENTS

| | | | |
|---|---|---|---|
| 1,023,834 | 4/1912 | Gareis | 281/31 |
| 5,030,027 | 7/1991 | Bachrach et al. | 281/37 X |
| 5,240,340 | 8/1993 | Lynch et al. | 281/31 X |
| 5,494,366 | 2/1996 | Pell et al. | 281/31 X |

*Primary Examiner*—Willmon Fridie, Jr.

*Attorney, Agent, or Firm*—W. Thomas Timmons; Timmons & Kelly

[57] ABSTRACT

A binding (B) for a plurality of sheets (10) has a front cover (12) attached to a rear cover (14) along a fold line (16). The front and rear covers (12 and 14) each have an interior and an exterior surface. A movable closure flap 26 is attached to the rear cover 14 joins the front and rear covers (12 and 14). A first retainer (34) attached to the front cover 12) and a second retainer (36) complementary thereto releasably secures the closure flap (26) to the front cover (12) in a closed position (32). A display jacket (38) has a front panel (40) connected to a rear panel (42). The front panel (40) has a passageway (46) through which the second retainer (36) releasably engages the first retainer (34). A front pocket (40) is formed with the interior side (20) of the front cover (12) and has an opening (50) facing a top edge (52) of the front cover (12) for receiving a flap (54) of the rear panel (42) of the display jacket (38).

18 Claims, 1 Drawing Sheet

FASTENABLE BINDER WITH INSERT

BACKGROUND OF THE INVENTION

1. Technical Field

The invention relates to the field of notebooks or portfolios and more particularly to a removable cover or insert for displaying graphics or other writings.

2. Background Art

Apparatus for storing and holding papers, such as portfolios, notebooks, and binders, are well known in the art. When such binders are packaged or prepared to be offered for sale, adding display material is difficult. Heretofore, manufacturers added a loose insert with the binder before the binder and insert were heat wrapped in plastic. Also, an advertising sticker can be affixed to the front cover of the binder. Both of these methods to add advertising material are inconvenient and time consuming to remove by the purchaser. Des. U.S. Pat. No. 324,877 to Schimmel discloses a three-ring binder with a clasp using a flap that secures the two sides together using hook and loop material, that is Velcro brand fasteners. The device does not disclose a removable insert or flyer.

U.S. Pat. No. 2,116,589 to Trussell discloses a booklet having perforations along a edge of the outer covers and inner pages. The booklet is bound together by a length of stiff wire formed in a series of rings in a well known manner. Again, the device does not disclose a removable insert or flyer.

U.S. Pat. No. 5,215,398 to White et al. teaches a three-part folder secured together with a clasp that may use hook and loop material for its operation. The device has a three-ring type paper holder in between each of the adjoining sections. The White patent also discloses sleeves for holding loose papers, and a pocket on the front cover for holding a business card. The White patent does not reveal means for holding a flyer on the outside of the device, nor does it show attaching anything to the device using the clasp of the folder.

U.S. Pat. No. 5,236,226 to Sheffield teaches a portfolio binder held together with a clasp. Like Schimmel, no loose pages or pieces of paper are attached to the outer portion of the apparatus.

U.S. Pat. No. 5,351,992 to Chilson et al. teaches an itinerary planner having two sides secured with a clasp. It has pockets for holding the spine of a note pad, a storage area for holding pens and other items by hook and loop material, and a transparent sleeve for holding a map. All these elements are on the interior of the device. The only item attached to the exterior of the device is a label, within another transparent sleeve, to show information such as the owner's address and other vital statistics. This is intended to be permanently held within the device rather than be easily removable.

U.S. Pat. No. 5,378,022 to French et al. teaches a pouch designed to attach to the front cover of a notebook to hold items such as pencils, erasers, etc.

Finally, U.S. Pat. No. 5,417,510 to Stout discloses a manner of attaching a cover to a wire loop type binder so that the loops are essentially enclosed within the cover. A removable insert is disclosed.

While the above cited references introduce and disclose a number of noteworthy advances and technological improvements within the art, none completely fulfills the specific objectives achieved by this invention.

DISCLOSURE OF INVENTION

In accordance with the present invention, a removable advertising display is presented for a binding for a plurality of sheets, such type as a book, a notebook, or a portfolio jacket, has a front cover attached to a rear cover along a fold line. The binding is adapted to receive the plurality of sheets between the front cover and rear cover. The front and rear covers each have an interior and an exterior surface. A movable closure flap having an inside surface is attached to the rear cover along an edge opposite the fold line to join the front and rear covers in a closed position. A first retainer is attached to the exterior surface of the front cover and a second retainer that is complementary to the first retainer is attached to the inside surface of the movable closure flap. The first and second retainers can be controllably engaged to releasably secure the movable closure flap to the front cover to keep the binding in a closed position.

A removable display jacket, which may have a design or other symbols imprinted thereon, has a front panel that is hingedly connected to a rear panel along an upper edge. The front panel of the display jacket has a passageway formed therein through which the second retainer releasably engages with the first retainer. A front pocket is formed with the interior side of the front cover and has an opening facing a top edge of the front cover to receive a portion of the rear panel of the removable display jacket.

When assembled the display jacket is releasably secured to the binding when the second retainer engages with the complementary first retainer through the passageway in the front panel of the display jacket. The purchaser of the binder merely releases the retaining mechanism and removes the display jacket from around the front cover.

These and other objects, advantages and features of this invention will be apparent from the following description taken with reference to the accompanying drawings, wherein is shown the preferred embodiments of the invention.

BRIEF DESCRIPTION OF THE DRAWINGS

A more particular description of the invention briefly summarized above is available from the exemplary embodiments illustrated in the drawing and discussed in further detail below. Through this reference, it can be seen how the above cited features, as well as others that will become apparent, are obtained and can be understood in detail. The drawings nevertheless illustrate only typical, preferred embodiments of the invention and are not to be considered limiting of its scope as the invention may admit to other equally effective embodiments.

MODE(S) FOR CARRYING OUT THE INVENTION

Figure 1:
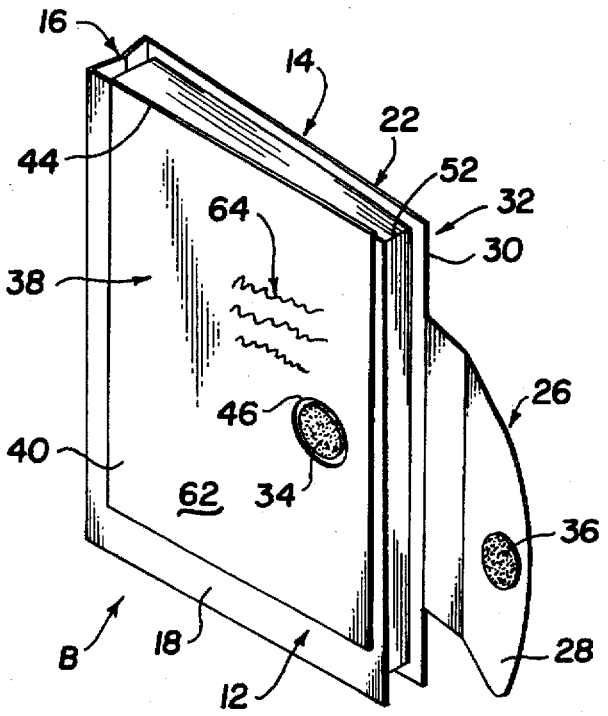
FIG. 1 is a perspective view of the present invention including a notebook and removable flyer.
Figure 2:
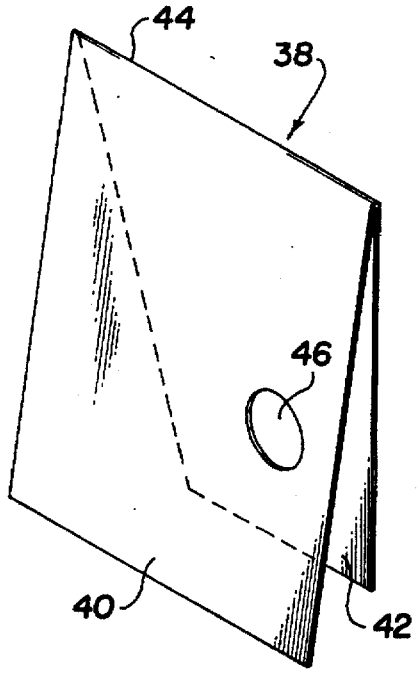
FIG. 2 is a perspective view of the removable flyer of FIG. 1 separated from the notebook.

So that the manner in which the above recited features, advantages and objects of the present invention are attained can be understood in detail, more particular description of the invention, briefly summarized above, may be had by reference to the embodiment thereof that is illustrated in the appended drawings. In all the drawings, identical numbers represent the same elements.

A binding B for a plurality of sheets 10 has a front cover 12 attached to a rear cover 14 along a fold line or spline 16.

The binding B can be such as a book, a notebook, a spiral binder, a ring binder, a portfolio jacket, or the like. The binding B is adapted to receive the plurality of sheets 10 between the front cover 12 and rear cover 14. The front cover 12 has an interior and an exterior surface 18 and 20, respectively. The rear cover 14 has an interior and an exterior surface 22 and 24, respectively. A movable closure flap 26 having an inside surface 28 is hingedly attached to the rear cover 14 along an edge 30 opposite the fold line 16 to join the from and rear covers 12 and 14 in a closed position 32.

A first retainer 34 is attached to the exterior or outer surface 18 of the front cover 12. A second retainer 36 that is complementary to the first retainer 34 is attached to the inside surface 28 of the movable closure flap 26. The first and second retainers 34 and 36 can be controllably engaged to releasably secure the movable closure flap 26 to the front cover 12 to keep the binding in the closed position 32.

Figure 3:
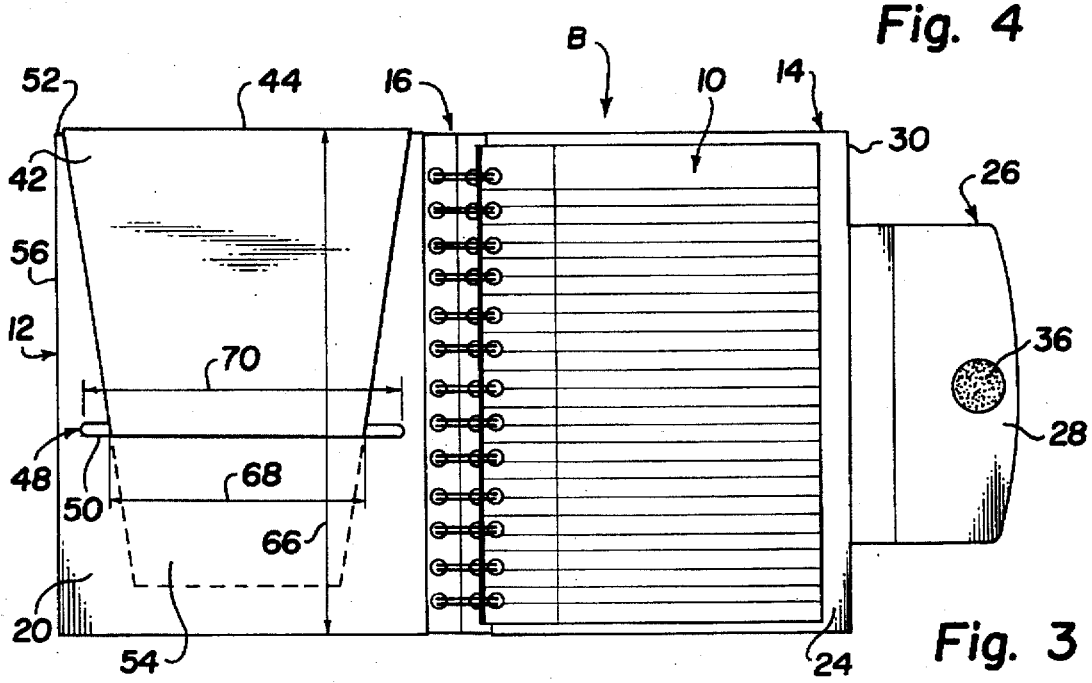
FIG. 3 is a plan view of the interior of the invention.

A removable display jacket 38 has a front panel 40 that is hingedly connected to a rear panel 42 along an upper edge 44. The display jacket 38 is adapted to receive the front cover 12 between the front panel 40 and the rear panel 42. The front panel 40 of the display jacket 38 has a passageway 46 formed therein through which the second retainer 36 releasably engages with the first retainer 34. A front pocket 48 is formed with the interior side 20 of the front cover 12 and has an opening 50 facing a top edge 52 of the front cover 12 to receive a flap or insert portion 54 (shown in phantom in FIG. 3) of the rear panel 42 of the removable display jacket 38. When assembled the display jacket 38 is releasably secured to the binding B when the second retainer 36 engages with the complementary first retainer 34 through the passageway 46 in the front panel 40 of the display jacket 38.

Alternatively, the opening 50 of the pocket 48 can face an outer edge 56 of the front cover 12 and the folded edge 44 of the display jacket 38 would be oriented appropriately.

Typically, the front panel 40 of the display jacket 38 extends substantially the height 66of the front cover 12. The rear panel 42 of the display jacket 38 generally extends less than the height 66 of the front cover 12.

Figure 4:
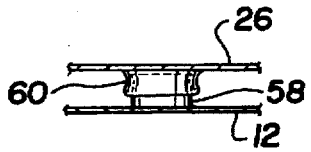
FIG. 4 is a side view of an alternative embodiment of the clasp for securing the cover of the portfolio.

Desirably, the first and second retaining means 34 and 36 are segment of the two parts of a hook and loop material. Alternatively, any other suitable clasps may be chosen such as that shown in FIG. 4 that has a male portion 58 shown, by way of example, to be attached to the front cover 12 and a complementary female portion 60 mounted on the movable closure flap 26. Also, the width 68 of the rear panel 42 of the display jacket 38 is desirably less than the length 70 of the opening 50 of the front pocket 48 that is formed with the inside 20 of the front cover 12.

Optionally, the passage 46 through the front panel 40 of the display jacket 38 is a circular hole cut in the front panel 40. The hole is positioned in the front panel 40 to permit the joining of the first and second retainers or fastening means 36 and 38. The size of the hole should be selected to accommodate the first and second fasteners 36 and 38 to pass therethrough and to secure the movable closure flap 26 to the front cover 12 retaining the binding B in the closed position 32.

The binding is constructed of known and usual materials for books, or other types of notebooks, portfolios or binders. The covers may be composed of cardboard, plastic sheeting, or other laminated or layered materials of suitable durability. The display jacket 38 typically is composed of a cardboard or other card-stock type of material. Alternatively, plastic sheeting or any other suitable semi-rigid material may be used. The outer face or surface 62 of the front panel may be imprinted with designs, symbols, or other types of advertising copy 64 as selected by the manufacturer. Such printing may also appear on other surfaces of the display jacket 38.

The foregoing disclosure and description of the invention are illustrative and explanatory thereof, and various changes in the size, shape and materials, as well as in the details of the illustrated construction may be made without departing from the spirit of the invention.

I claim:

1. In combination with a binding for a plurality of sheets of the type having a front cover attached to a rear cover along a fold line with the front and rear covers each having an interior and an exterior surface, the invention comprising:

a movable closure flap having an inside surface attached to the rear cover along an edge opposite the fold line joining the front and rear covers;

a first retaining means attached to the exterior surface of the front cover and a second retaining means complementary to the first retaining means attached to the inside surface of the movable closure flap for releasable securing the movable closure flap to the front cover in a closed position;

a removable display jacket having a front panel hingedly connected to a rear panel along an upper edge; the display jacket being adapted to receive the front cover between the front panel and the rear panel;

the front panel of the display jacket having a passageway formed therein through which the second retaining means is releasably engaged with the first retaining means; and a front pocket formed with the interior side of the front cover having an opening facing a top edge of the front cover for receiving a portion of the rear panel of the removable display jacket;

whereby the display jacket is releasably secured to the binding when the second retaining means is engaged with the complementary first retaining means through the passageway in the front panel of the display jacket when the binding is in a closed position.

2. The invention of claim 1 wherein the front panel of the display jacket extends substantially the height of the front cover and the rear panel of the display jacket extends less than the height of the front cover.

3. The invention of claim 1 wherein the first retaining means and the second retaining means comprise hook and loop fastening material.

4. The invention of claim 1 wherein the first retaining means and the second retaining means comprise the male and female portions of a clasp.

5. The invention of claim 1 wherein the width of the rear panel of the display jacket is less than the length of the front pocket with the inside of the front cover.

6. The invention of claim 1 wherein the passageway in the front panel of the display jacket is circular with a diameter selected to accomodate the first and second retaining means therethrough.

7. The invention of claim 1 wherein the display jecket comprises a cardboard material.

8. The invention of claim 1 wherein the display jecket comprises a semi-rigid material.

9. The invention of claim 1 wherein the front panel of the display jacket is adapted to receive a desired design marked thereon.

10. A binding for a plurality of sheets comprising:

a front cover attached to a rear cover along a fold line adapted to receive the plurality of sheets between the front cover and rear cover; the front and rear covers each having an interior and an exterior surface;

a movable closure flap having an inside surface attached to the rear cover along an edge opposite the fold line joining the front and rear covers;

a first retaining means attached to the exterior surface of the front cover and a second retaining means complementary to the first retaining means attached to the inside surface of the movable closure flap for releasable securing the movable closure flap to the front cover in a closed position;

a removable display jacket having a front panel hingedly connected to a rear panel along an upper edge; the display jacket being adapted to receive the front cover between the front panel and the rear panel;

the front panel of the display jacket having a passageway formed therein through which the second retaining means is releasably engaged with the first retaining means; and a front pocket formed with the interior side of the front cover having an opening facing a top edge of the front cover for receiving a portion of the rear panel of the removable display jacket;

whereby the display jacket is releasably secured to the binding when the second retaining means is engaged with the complementary first retaining means through the passageway in the front panel of the display jacket when the binding is in a closed position.

11. The invention of claim 10 wherein the front panel of the display jacket extends substantially the height of the front cover and the rear panel of the display jacket extends less than the height of the front cover.

12. The invention of claim 10 wherein the first retaining means and the second retaining means comprise hook and loop fastening material.

13. The invention of claim 10 wherein the first retaining means and the second retaining means comprise the male and female portions of a clasp.

14. The invention of claim 10 wherein the width of the rear panel of the display jacket is less than the length of the front pocket with the inside of the front cover.

15. The invention of claim 10 wherein the passageway in the front panel of the display jacket is circular with a diameter selected to accomodate the first and second retaining means therethrough.

16. The invention of claim 10 wherein the display jecket comprises a cardboard material.

17. The invention of claim 10 wherein the display jecket comprises a semi-rigid material.

18. The invention of claim 10 wherein the front panel of the display jacket is adapted to receive a desired design marked thereon.

* * * * *